US009855487B2

(12) United States Patent
Chartrand et al.

(10) Patent No.: US 9,855,487 B2
(45) Date of Patent: Jan. 2, 2018

(54) BLADE HOLDER ASSEMBLY

(71) Applicant: SPORT MASKA INC., Montreal (CA)

(72) Inventors: Daniel Chartrand, Lorraine (CA); Bernard Daoust, Sutton (CA)

(73) Assignee: SPORT MASKA INC., Montreal (CA)

( * ) Notice: Subject to any disclaimer, the term of this patent is extended or adjusted under 35 U.S.C. 154(b) by 0 days.

(21) Appl. No.: 15/451,728

(22) Filed: Mar. 7, 2017

(65) Prior Publication Data

US 2017/0259159 A1 Sep. 14, 2017

Related U.S. Application Data

(60) Provisional application No. 62/329,281, filed on Apr. 29, 2016, provisional application No. 62/305,180, filed on Mar. 8, 2016.

(51) Int. Cl.

| | |
|---|---|
| ***A63C 1/02*** | (2006.01) |
| ***A63C 1/30*** | (2006.01) |
| ***A63C 1/22*** | (2006.01) |

(52) U.S. Cl.

CPC ..... *A63C 1/303* (2013.01); *A63C 1/02* (2013.01); *A63C 1/22* (2013.01)

(58) Field of Classification Search

CPC .. A63C 1/303; A63C 1/22; A63C 1/20; A63C 1/02

See application file for complete search history.

(56) References Cited

U.S. PATENT DOCUMENTS

| | | | | | |
|---|---|---|---|---|---|
| 3,026,118 | A * | 3/1962 | Pare | A63C 1/20 | 280/11.3 |
| 4,251,086 | A * | 2/1981 | Woolley | A63C 1/02 | 264/274 |
| 4,353,562 | A * | 10/1982 | Tiefenthal | A63C 1/22 | 280/11.18 |
| 5,088,749 | A * | 2/1992 | Olivieri | A63C 1/20 | 280/11.18 |
| 5,332,242 | A * | 7/1994 | Cann | A63C 1/30 | 280/11.18 |
| 5,484,148 | A * | 1/1996 | Olivieri | A63C 1/30 | 280/11.17 |
| D396,515 | S | 7/1998 | Venier et al. | | |
| 5,988,683 | A | 11/1999 | Venier et al. | | |
| 6,039,328 | A * | 3/2000 | Pawlowski | A63C 1/30 | 280/11.12 |

(Continued)

*Primary Examiner* — Erez Gurari
(74) *Attorney, Agent, or Firm* — Norton Rose Fulbright Canada

(57) ABSTRACT

A blade holder assembly for a skate including a blade holder having an elongated groove defined in a bottom surface, and a recess extending upwardly therefrom in alignment with a pedestal, for engagement with a blade. The pedestal has an internal cavity defined therein separate and spaced from the elongated groove and the recess. A locking arm is engaged to the pedestal and movable between a locked position and an unlocked position. The locking arm has an engagement end protruding into the recess through an opening defined in a wall of the pedestal. A greater portion of the engagement end protrudes into the recess in the locked position than in the unlocked position. At least a major part of the locking arm, including the engagement end, remains outside of the internal cavity of the pedestal in the locked and unlocked positions. A blade assembly is also discussed.

22 Claims, 18 Drawing Sheets

(56) References Cited

U.S. PATENT DOCUMENTS

| | | | | |
|---|---|---|---|---|
| 6,523,835 | B1 * | 2/2003 | Lyden | A63C 1/30 280/11.12 |
| D631,120 | S * | 1/2011 | Salmon | D21/761 |
| 8,297,627 | B2 | 10/2012 | Smith, II | |
| 8,353,535 | B2 | 1/2013 | Salmon et al. | |
| 8,454,030 | B2 * | 6/2013 | Corbeil | A63C 1/303 280/10 |
| 8,534,680 | B1 | 9/2013 | Corbeil et al. | |
| 8,550,472 | B2 | 10/2013 | Salmon et al. | |
| 9,717,300 | B2 * | 8/2017 | Van Horne | A43L 35/16 |
| 2005/0167934 | A1 * | 8/2005 | Smith | A63C 1/30 280/28 |
| 2011/0121527 | A1 * | 5/2011 | Salmon | A63C 1/303 280/11.12 |
| 2013/0038031 | A1 * | 2/2013 | Cruikshank | A63C 1/22 280/11.18 |
| 2013/0285338 | A1 * | 10/2013 | Blois | A63C 1/30 280/11.14 |
| 2014/0062041 | A1 * | 3/2014 | M Rs | A63C 1/303 280/11.15 |
| 2014/0284890 | A1 * | 9/2014 | Wuerthner | A63C 1/303 280/11.12 |
| 2017/0028291 | A1 * | 2/2017 | Green | A63C 1/303 |

* cited by examiner

BLADE HOLDER ASSEMBLY

CROSS-REFERENCE TO RELATED APPLICATIONS

This application claims priority from U.S. application No. 62/329,281 filed Mar. 29, 2016 and from U.S. application No. 62/305,180 filed Mar. 8, 2016, the entire contents of which are incorporated by reference herein.

TECHNICAL FIELD

The application relates generally to ice skates and, more particularly, to ice skates having replaceable blades.

BACKGROUND OF THE ART

Since skate boots are generally more durable than skate blades, it is known to provide skates with steel blades detachably received within a holder of the skate, such that the blades can be replaced when worn out or damaged. However, existing attachment mechanisms for the blades can be difficult to actuate, be difficult to access by a user, and/or require the use of tools to remove and replace the blade.

SUMMARY

In one aspect, there is provided a blade assembly for a skate, the assembly comprising: a blade holder including first and second pedestals configured for attachment to the skate, the blade holder having a bottom surface having an elongated groove defined therein, the blade holder having a plurality of recesses defined therein extending upwardly from the elongated groove, the first and second pedestals each having a bottom wall extending above the elongated groove and an internal cavity defined above the bottom wall; an elongated blade including a body defining an ice-engaging edge, an elongated top edge opposite the ice-engaging edge, and a plurality of projections extending upwardly from the body, the blade and blade holder relatively moveable between an engagement position where the elongated top edge is engaged in the elongated groove and the plurality of projections are each received in a respective one of the recesses, and a disengagement position where the blade is disengaged from the recesses and the elongated groove; and a locking arm engaged to the holder and movable between a locked position and an unlocked position; wherein in the locked position, the locking arm has an engagement end engaging the blade through an opening defined in a wall of the holder and maintaining the blade in the engagement position; wherein in the unlocked position, the locking arm is disengaged from the blade and the blade is movable to the disengagement position; and wherein a major part of the locking arm including the engagement end remains outside of the internal cavities of the first and second pedestals in the locked and unlocked positions.

In another aspect, there is provided a blade holder assembly for a skate, the assembly comprising: a blade holder having a bottom surface partially defined by a pedestal configured for interconnection with a boot of the skate, the bottom surface of the blade holder having an elongated groove defined therein and a recess extending upwardly from the elongated groove in alignment with the pedestal, the elongated groove configured for removably engaging a top edge of a blade and the recess configured for removably engaging a projection of the blade, the pedestal having an internal cavity defined therein separate and spaced from the elongated groove and the recess; and a locking arm engaged to the holder and movable between a locked position and an unlocked position, the locking arm including a finger-engaging portion for manipulation by a user; wherein in the locked position, the locking arm has an engagement end protruding into the recess through an opening defined in a wall of the pedestal, a greater portion of the engagement end protruding into the recess in the locked position than in the unlocked position; and wherein a major part of the locking arm including the engagement end and the finger-engaging portion remains outside of the internal cavity of the pedestal in the locked and unlocked positions.

DESCRIPTION OF THE DRAWINGS

Reference is now made to the accompanying figures in which.

DETAILED DESCRIPTION

Figure 1:
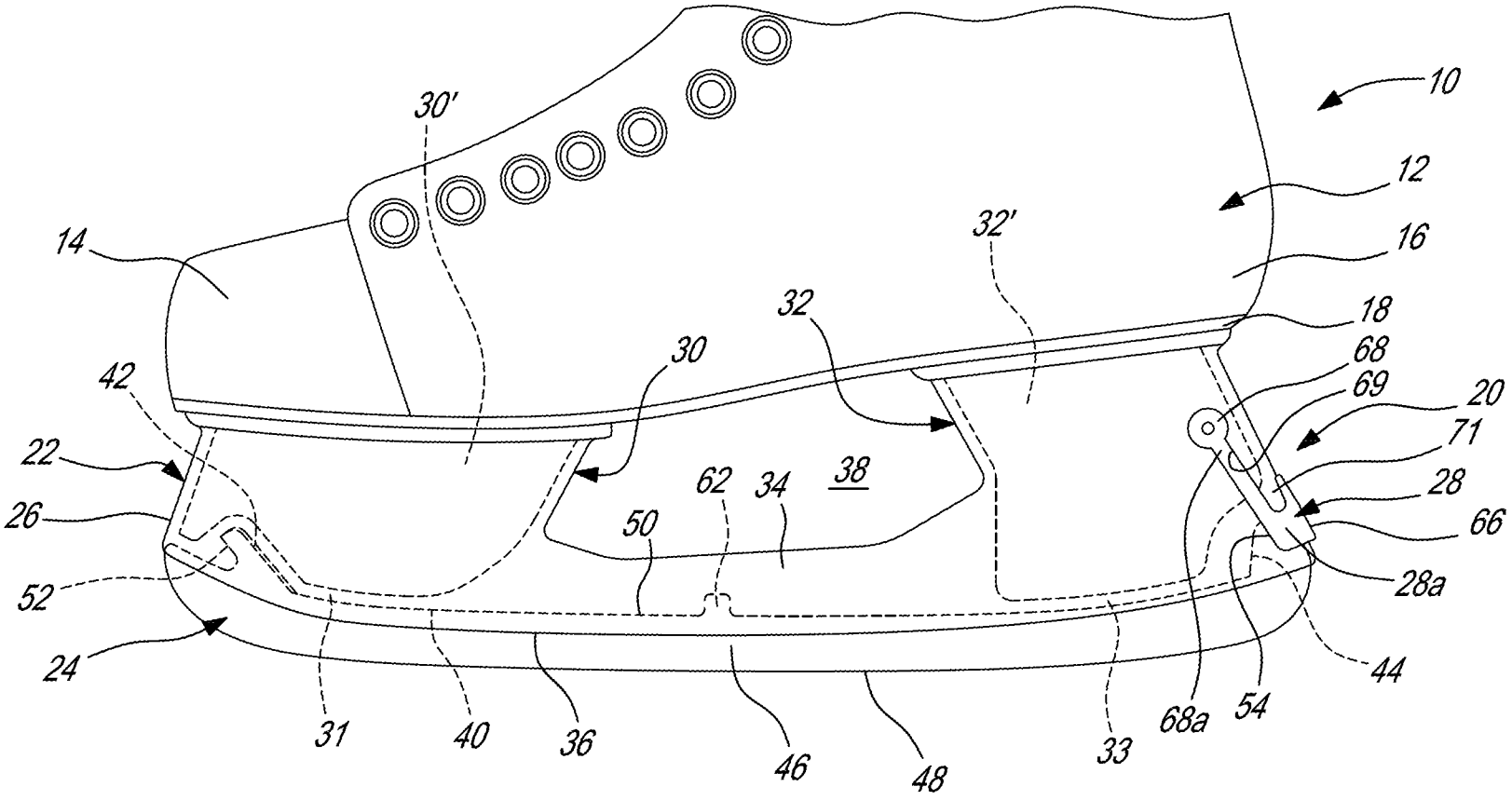
FIG. 1 is a schematic side view of part of a skate with a blade holder, locking arm and blade according to a particular embodiment, the locking arm being shown in a locked position.

Referring to FIG. 1, a skate 10 according to a particular embodiment is partially shown. The skate includes a skate boot 12 with opposed toe and heel portions 14, 16. A sole 18 extends along the bottom the skate boot 12, from the toe portion 14 to the heel portion 16. A blade assembly 20 is connected underneath the sole 18. The blade assembly 20 generally includes a blade holder assembly 22 and a blade 24.

Figure 2:
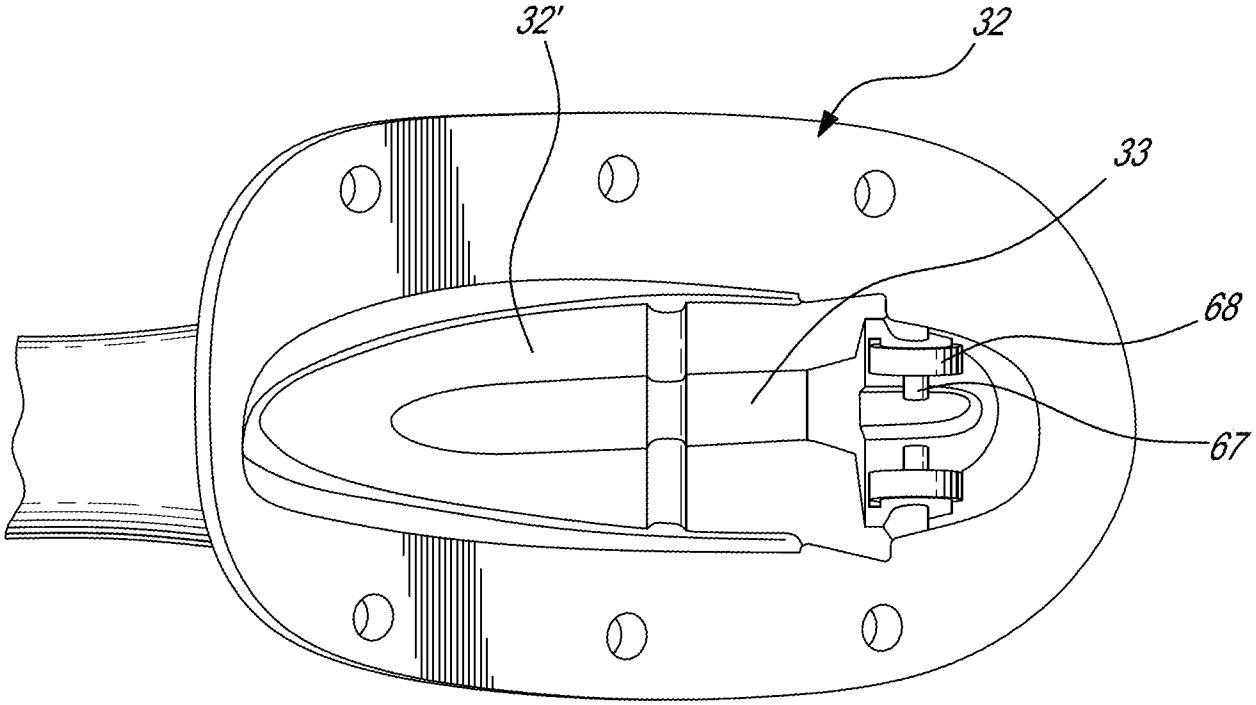
FIG. 2 is a schematic top view of part of the blade holder of FIG. 1.

The blade holder assembly 22 includes a blade holder 26 which includes a front pedestal 30 having a top end connected to the sole 18 along the toe portion 14 of the boot 12, a rear pedestal 32 having a top end connected to the sole 18 in the heel portion 16 of the boot 12, and a bridge portion 34 interconnecting the pedestals 30, 32. Each pedestal 30, 32 has an empty configuration, with outer walls surrounding an interior cavity 30', 32'. In a particular embodiment and as illustrated in FIG. 2, the top end of each pedestal 30, 32 (only the rear pedestal 32 being shown in FIG. 2) has a top opening defined therein in communication with the pedestal cavity 30', 32'. Although not shown, one or more ribs may extend within the cavities 30', 32', for example dividing the cavities 30', 32' in a plurality of adjacent hollow spaces. The bottom end of each pedestal cavity 30', 32' is closed by a bottom wall 31, 33. Referring back to FIG. 1, a bottom surface 36 of the blade holder 26 is defined by the bottom walls 31, 33 of the pedestals 30, 32 and by the bridge portion 34.

In the embodiment shown, the bridge portion 34 is spaced from the sole 18 of the boot 12, and is not connected thereto, such that an opening 38 is defined between the sole 18 and the bridge portion 34, bordered by the pedestals 30, 32. Alternately, the bridge portion 34 may extend up to the sole 18 of the boot; for example, the blade holder 26 may be defined as a continuous element without any apparent distinction between the pedestals 30, 32 and bridge portion 34. Moreover, although shown as a single piece, the bridge portion 34 may alternately include a plurality of interconnected ribs defining openings therebetween. It is understood that the configuration of the pedestals 30, 32 and bridge portion 34 shown in exemplary only and that the pedestals 30, 32 and bridge portion 34 can alternately have any other appropriate configuration.

The bottom surface 36 of the blade holder 26 has an elongated groove 40 defined therein, and the blade holder further includes front and rear recesses 42, 44 defined therein, extending upwardly from the elongated groove 40 in alignment with each pedestal 30, 32. In the embodiment shown, the groove 40 and recesses 42, 44 are not in communication with the pedestal's internal cavities 30', 32'; the bottom walls 31, 33 extend between the internal cavities 30', 32' and the groove 40 and recesses 42, 44. The groove 40 and recesses 42, 44 are thus separate from the internal cavities 30', 32'.

The blade 24 has a body 46 having a generally planar shape, preferably having a constant thickness. In a particular embodiment, the blade 24 is made of steel; other appropriate materials may alternately be used. The body 46 defines an ice-engaging edge 48 configured to slide on ice, and an elongated top edge 50 opposite the ice-engaging edge 48. Two projections 52, 54 extend upwardly from the body 46: a front projection 52 at the front of the blade 24, and a rear projection 54 at the rear of the blade 24.

The top edge 50 of the blade 24 and the elongated groove 40 of the holder 26 are configured and sized such as to be complementary and removably engageable together. The front projection 52 of the blade 24 and the front recess 42 are configured, positioned and sized such as to be removably engageable on into the other; the rear projection 54 of the blade 24 and the rear recess 44 are configured, positioned and sized such as to be removably engageable one into the other. More particularly, the projections 52, 54 and recesses 42, 44 are configured, positioned and sized such that the blade 24 and blade holder 26 are relatively moveable, with the projections 52, 54 moveable together within their respective recess 42, 44, between an engagement position and a disengagement position. In the engagement position of the blade 24 and holder 26, abutting surfaces of the projections 52, 54 and recesses 42, 44 and interaction between a locking arm 28 (described further below) with the blade 24 prevent removal or disengagement of the projections 52, 54 from the recesses 42, 44, thus maintaining the blade 24 in the holder 26. In the disengagement position, the blade 24 is removed from the holder 26; the projections 52, 54 thus have appropriate freedom of movement within the respective recess 42, 44 to allow disengagement of the blade 24 from the recesses 42, 44 and elongated groove 40. Movement between the engagement and disengagement positions of the blade 24 and holder 26 may include translation (e.g. along a longitudinal direction of the blade 24 and/or along an angled direction non-parallel to the longitudinal direction and the vertical direction) and/or rotation of the blade 24 (e.g. pivot around a point defined in or around the recess 42 of the front pedestal 30), depending on the configuration of the projections 52, 54 and recesses 42, 44.

The blade 24 does not penetrate the internal cavities 30', 32' of the blade holder 26. In the embodiment shown, the engagement position of the blade 24 and holder 26 is defined where the projections 52, 54 are at their forwardmost position within the recesses 42, 44 (as shown in FIG. 1). The front projection 52 has a trapezoidal shape defined by two angled edges extending from the blade body 46 with an orientation non perpendicular to the top edge 50 of the blade. The front projection 52 is angled such as to extend forwardly as it extends away from the blade body 46. As can be best seen in FIG. 4, the rear projection 54 has a curved hook shape defined by spaced apart convex and concave edges 56, 58 extending from the blade body 46, with the concave edge 58 being disposed rearwardly of the convex edge 56 such as to define a rearwardly open slot 60.

Referring back to FIG. 1, in the embodiment shown the blade 24 further includes an intermediate projection 62 shaped as a tab extending from the blade body 46 between the front and rear projections 52, 54, removably received in a corresponding intermediate recess extending from the elongated groove 40 within the bridge portion 34, the intermediate projection 62 and corresponding recess configured, positioned and sized to allow the movement of the blade 24 between the engagement and disengagement positions. In the embodiment shown, the intermediate projection 62 has a substantial rectangular shape defined by two edges extending from the blade body 46 with an orientation perpendicular or approximately perpendicular to the top edge 50 of the blade 24. Alternately, the intermediate projection 62 may be omitted, or more than one intermediate projections may be provided spaced along the length of the blade 24 between the front and rear projections 52, 54.

It is understood that the projections 52, 54, 62 may have any other appropriate shape including, but not limited to, any appropriate angled and/or curved shape.

Figure 4:
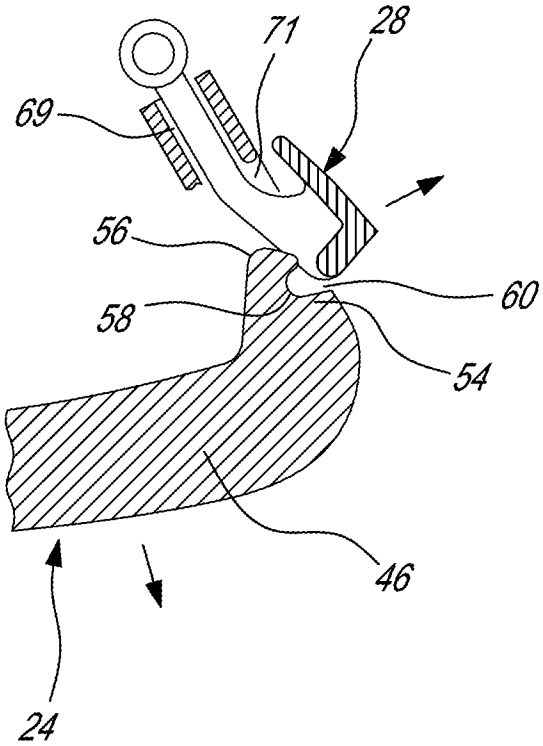
FIG. 4 is a schematic cross-sectional view of the locking arm and part of the blade of FIG. 1, with the locking arm in an unlocked position.

Referring to FIGS. 1-5, the locking arm 28 of the blade holder assembly 22 for maintaining the blade 24 and holder 26 in their engagement position will now be described. In the embodiment shown, the locking arm 28 is connected to the rear pedestal 32. The locking arm 28 is movable between a locked position (FIGS. 1, 3 and 5) and an unlocked position (FIG. 4). In the locked position, the locking arm 28 maintains the blade 24 in its engagement position. In the unlocked position, the locking arm 28 allows the blade 24 to move to the disengagement position.

Figure 3:
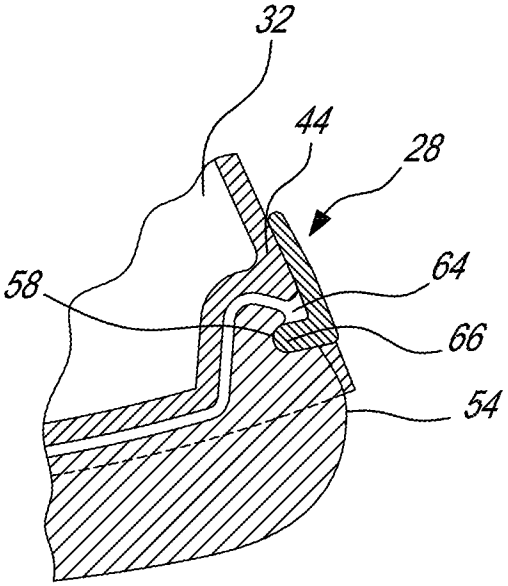
FIG. 3 is a schematic cross-sectional view of the locking arm and part of the blade holder and blade of FIG. 1, with the locking arm in the locked position.
Figure 5:
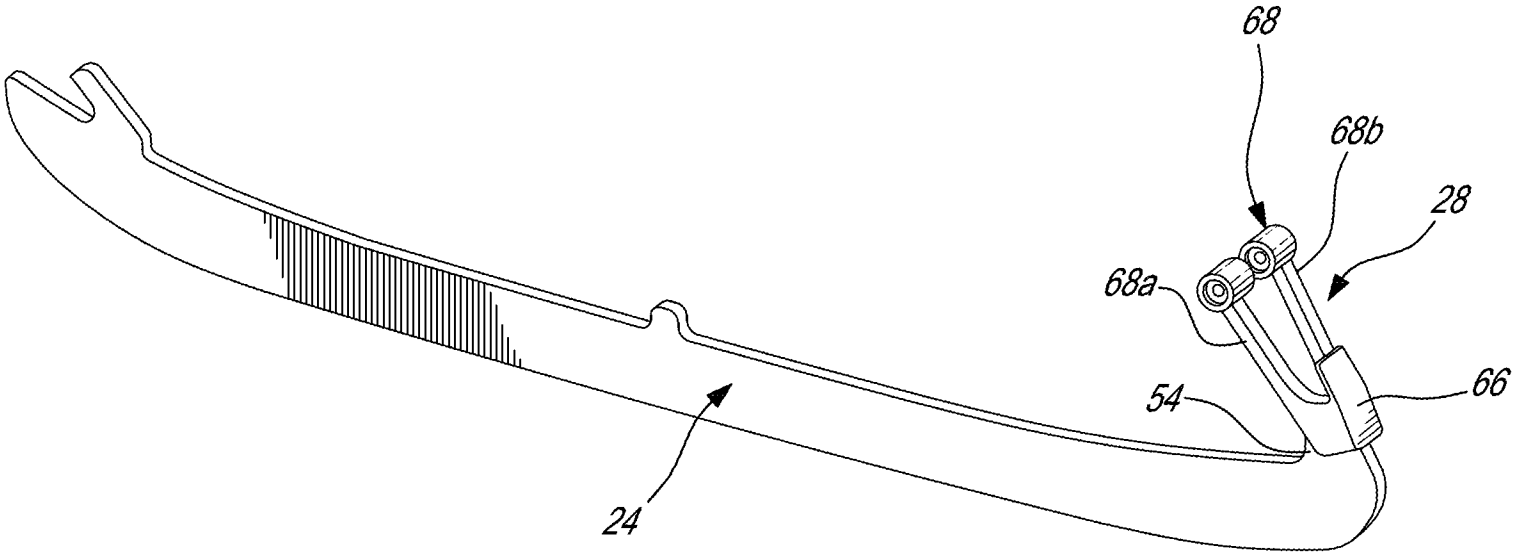
FIG. 5 is a schematic tridimensional view of the locking arm and blade of FIG. 1, with the locking arm in the locked position.

Referring to FIG. 3, an outer wall of the rear pedestal 32 has an opening 64 (see also embodiment of FIG. 9 for improved clarity) defined therethrough in communication with the recess 44. The opening 64 is separate from the internal cavity 32' of the rear pedestal 32, and does not communicate therewith. The locking arm 28 has an engagement end 66 which in the locked position penetrates in the pedestal 32 through this opening 64 to engage the rear projection 54, thus maintaining the rear projection 54 in the recess 44 and maintaining or biasing the blade 24 in the engagement position. In this embodiment, the opening 64 is defined in a rear-facing surface such that the engagement end 66 enters the recess 44 through the opening 64 through movement along a generally forward direction, and the relatively small engagement end 66 is the only portion of the locking arm 28 which penetrates in the pedestal 32. Referring to FIG. 4, in the unlocked position, the locking arm 28 is disengaged from the rear projection 54, so that the blade is moveable to its disengagement position where both projections 52, 54 are removed from their respective recess 42, 44 to disengage the blade 24 from the holder 26. A greater portion of the engagement end 66 is thus received in the recess 44 in the locked position than in the unlocked position; for example, the engagement end 66 may be completely outside of the recess 44 in the unlocked position.

A major part of the locking arm 28, including a finger-engaging portion 28*a* configured to be manipulated by the user and the engagement end 66, remains outside of the pedestal's internal cavities 30', 32' in both the locked and unlocked positions; in the embodiment shown, a major part of the locking arm 28 remains outside of the holder 26 as a whole, i.e. exposed to the environment, in both the locked and unlocked positions. The locking arm 28 is thus directly accessible to the user for actuation without requiring inserting one or more fingers within a cavity of the holder. This is in contrast to a number of prior art mechanisms where the locking member(s) are received inside a cavity of the pedestal and thus may be difficult to access by the user.

Referring back to FIG. 3, in the locked position of the embodiment shown, the engagement end 66 of the locking arm 28 abuts and interlocks with the concave edge 58 of the rear projection 54. The engagement end 66 has an L-shaped cross section, sized and configured to be receivable within the rearwardly open slot 60 (see FIG. 4) of the rear projection 54.

Referring back to FIG. 1, the locking arm 28 rests against an outer surface of the wall of the pedestal 32, and has a connection end 68 opposed from the engagement end 66 and located outside of the pedestal 32. The connection end 68 is connected to the rear pedestal 32 in a fixed location. The connection end 68 is upwardly spaced from the engagement end 66, i.e. located closer to the sole 18 than the engagement end 66. Referring to FIG. 2, in the embodiment shown a minimal portion of the connection end 68 penetrates into the rear pedestal 32. In alternate embodiments, some of which will be described further below, the whole locking arm remains outside of the pedestal's internal cavities 30', 32' in both the locked and unlocked positions, and outside of the holder 26.

In a particular embodiment, the connection between the rear pedestal 32 and the connection end 68 is rigid, i.e. blocked in rotation. In the embodiment show, and as can be best seen in FIG. 5, the locking arm 28 is U-shaped, such that the connection end 68 is defined by the upper end of two legs 68*a*, 68*b* extending upwardly from the engagement end 66. Referring back to FIG. 1, the rear pedestal 32 includes a groove 69 on each side snuggly receiving the corresponding leg 68*a*, 68*b* of the locking arm 28, including the connection end 68, and the engagement between the walls of the grooves 69 and the legs 68*a*, 68*b* of the locking arm 28 prevents rotation of the upper portion of the locking arm 28. The connection end 68 is connected to the pedestal 32 and maintained in the grooves 69 using any appropriate type of fastener or attachment mechanism, for example a pin 67 extending through the rear pedestal 32 between the two legs 68*a*, 68*b* (see FIG. 2). A recess 71 defined in the outer surface of the rear pedestal 32 under the groove 69 allows the lower portion of the locking arm 28, including the engagement end 66 to move with respect to the pedestal 32. The locking arm 28 is deformable and the lower portions of the legs 68*a*, 68*b* bend when moving from the locked position to the unlocked position, thus allowing the engagement end 66 to pivot away from the outer surface of the wall. The locking arm 28 is reversibly (e.g. elastically) deformed when in the unlocked position, such that its deformation biases the locking arm 28 back toward the locked position.

Figure 6:
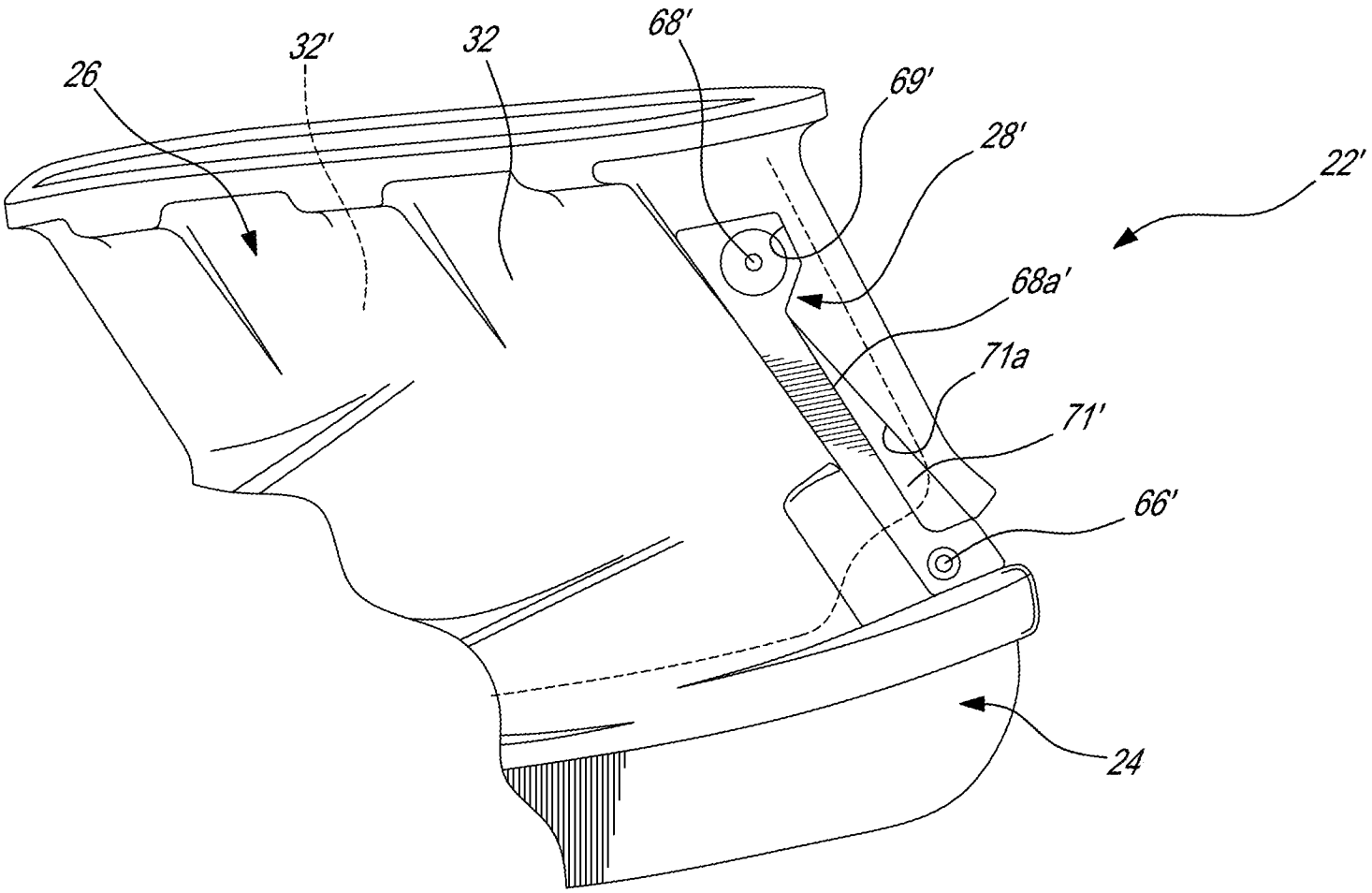
FIG. 6 is a schematic side view of part of a blade holder and blade, and of a locking arm according to another particular embodiment, the locking arm being shown in a locked position.
Figure 7:
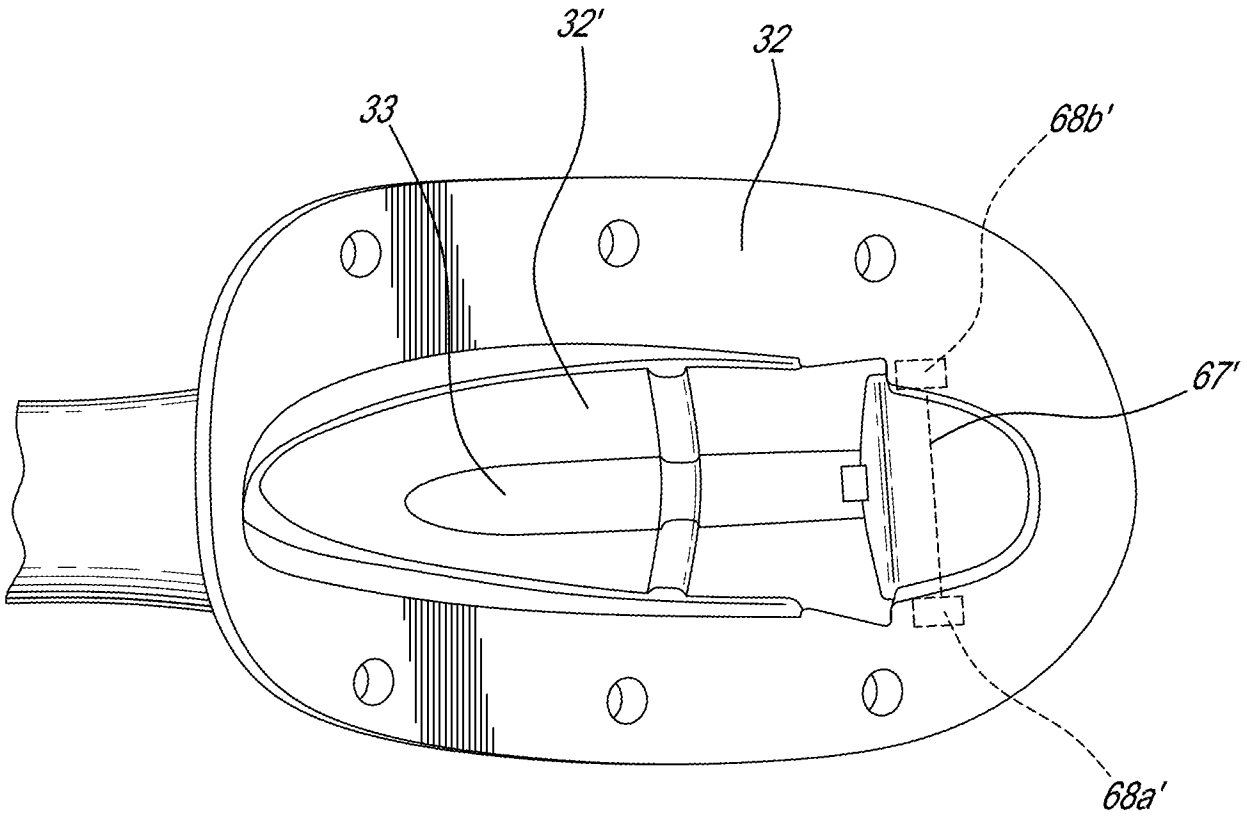
FIG. 7 is a schematic top view of part of the blade holder of FIG. 6.
Figure 8:
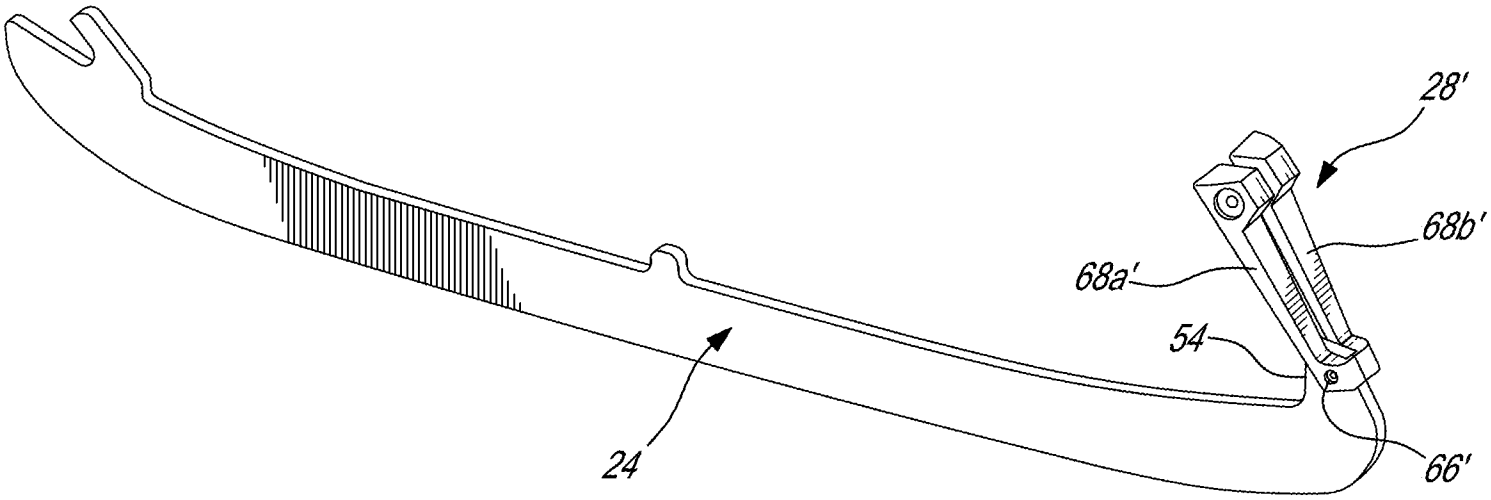
FIG. 8 is a schematic tridimensional view of the locking arm and blade of FIG. 6, with the locking arm in the locked position.

Referring to FIGS. 6-8, an alternate embodiment of the holder assembly 22' is shown, where the blade 24 and holder 26 are similar to that previously described, but with a locking arm 28' having a different configuration. As can be best seen in FIG. 8, the locking arm 28' is also U-shaped with the connection end 68' defined by the upper end of two legs 68*a*', 68*b*', and with the engagement end 66' defined by a pin interconnecting the legs 68*a*', 68*b*'; in the locked position shown, the pin 66' is sized and configured to be receivable within the rearwardly open slot 60 (see FIG. 4) of the rear projection 54 of the blade 24.

As can be seen in FIG. 7, the legs 68*a*', 68*b*' are interconnected at the connection end 68' by a pin 67' extending through the pedestal 32 while remaining outside of its internal cavity 32'. The whole locking arm 28' remains outside of the pedestal's internal cavities 30', 32' in both the locked and unlocked positions.

Referring to FIG. 6, each leg 68*a*', 68*b*' has at the connection end 68' a cross-section defining a plurality of straight edges. The rear pedestal 32 includes a groove 69' on each side having a shape complementary to the connection end 68' received therein, and the engagement of the edges of the connection end 68' with the corresponding edges of the groove 69' prevents rotation of the connection end 68'. The lower portion of the legs is received in a recess 71' defined in the outer surface of the rear pedestal 32 under the grooves 69', sized to allow the lower portion to move with respect to the pedestal 32 upon deformation of the locking arm 28', when its lower portion bends from the locked position to the unlocked position in abutment with a rear wall 71*a* of the recess 71'. The locking arm 28' is reversibly (e.g. elastically)

deformed when in the unlocked position, such that its deformation biases the locking arm 28' back toward the locked position.

Figure 9:
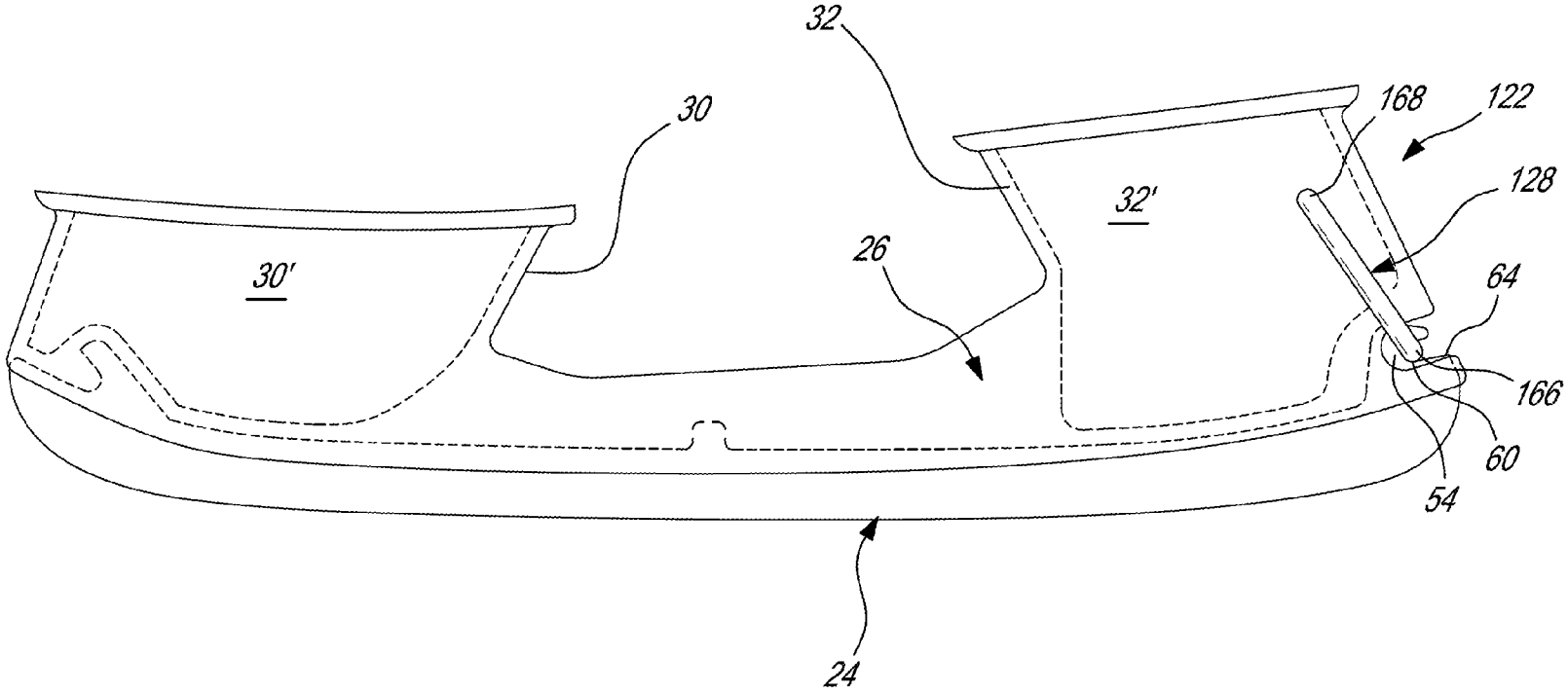
FIG. 9 is a schematic side view of a blade holder, locking arm and blade according to another particular embodiment, the locking arm being shown in a locked position.
Figure 10:
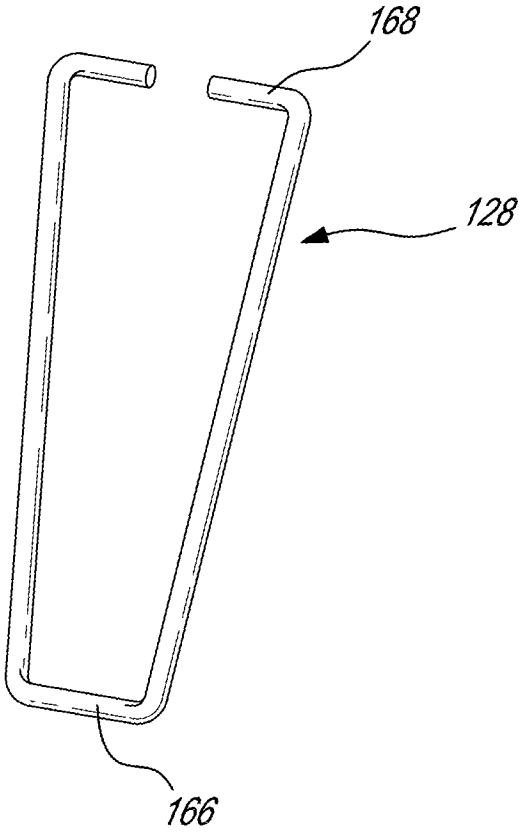
FIG. 10 is a schematic tridimensional view of the locking arm of FIG. 9.

Referring to FIGS. 9-10, another alternate embodiment of the holder assembly 122 is shown, with a locking arm 128 having another different configuration. As can be best seen in FIG. 10, the locking arm 128 is configured as a U-shaped wire, the transverse portion of the U-shape defining the engagement end 166 receivable within the rearwardly open slot 60 of the rear projection 54. Referring back to FIG. 9, the connection end 168 of the locking arm 128 is connected to the rear pedestal 32, for example by penetrating the wall of the rear pedestal without entering the internal cavity 32' so that the whole locking arm 128 remains outside of the pedestal's internal cavities 30', 32' in both the locked and unlocked positions. The U-shaped wire acts as a spring deforming when moving to the unlocked position and biasing the locking arm 128 toward the locked position. Alternately, a separate spring or any other appropriate biasing member may be connected to the locking arm 128.

Referring to FIGS. 11-14, a holder assembly 222 in accordance with another embodiment is shown. In this embodiment, the front and rear projections 252, 254 of the blade as well as an intermediate projection 262 of the blade each have a curved hook shape defined by spaced apart convex and concave edges extending from the blade body 46, with the concave edge of each projection being disposed rearwardly of its convex edge.

As in the previous embodiments, the front and rear projection 252, 254 are removably engageable in their respective recesses 242, 244 and moveable together within their respective recess 242, 244 to allow relative movement between the blade and holder between the engagement position (forwardmost position in embodiment shown) where the projections 252, 254 are prevented from disengagement from the recesses 242, 244 and the disengagement position where the projections 252, 254 are removed from their respective recess 242, 244. The elongated groove 240 in the holder's bottom surface and the recesses 242, 244 are not in communication with the pedestal's internal cavities 230', 232'; bottom walls 231, 233 extend between the internal cavities 230', 232' and the groove 240 and recesses 242, 244. The groove 240 and recesses 242, 244 are thus separate from the internal cavities 230', 232', and the blade does not penetrate the internal cavities 230', 232'.

Figure 11:
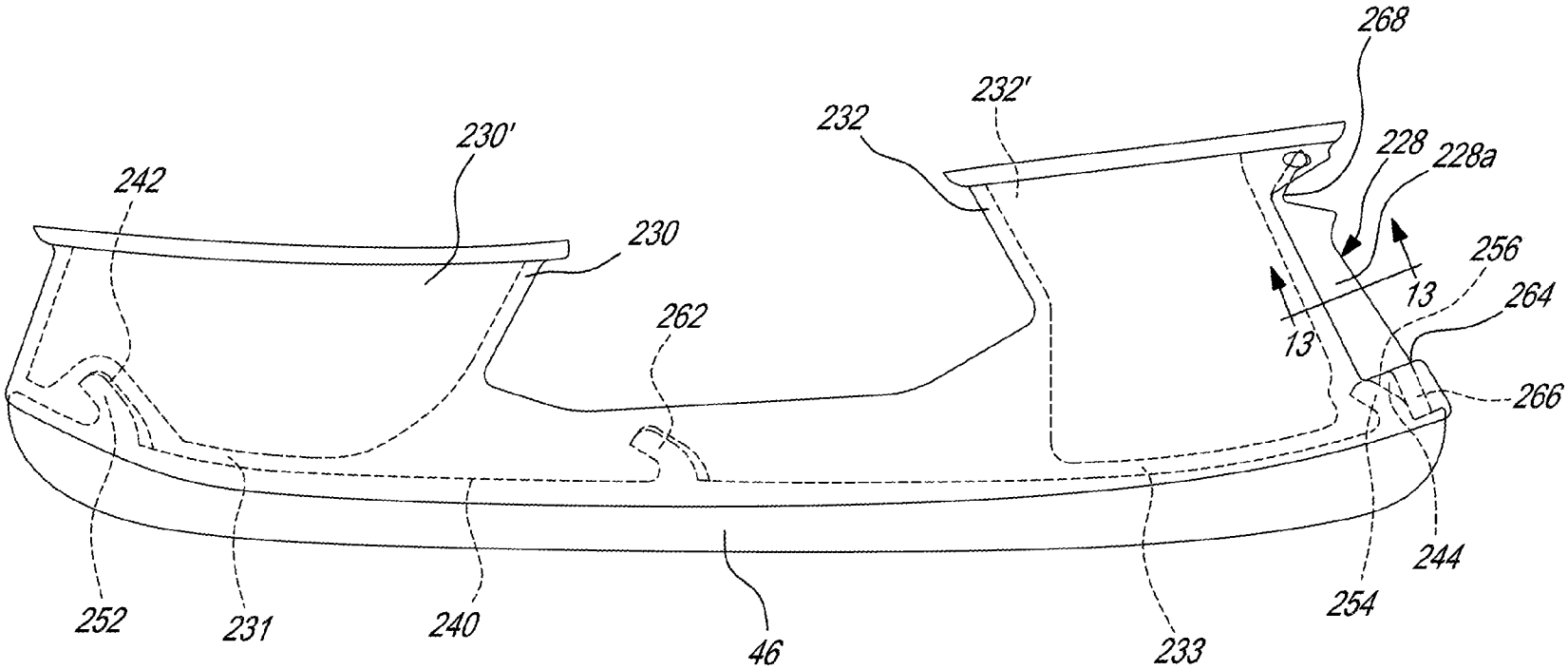
FIG. 11 is a schematic side view of a blade holder, locking arm and blade according to a further particular embodiment, the locking arm being shown in a locked position.
Figure 14:
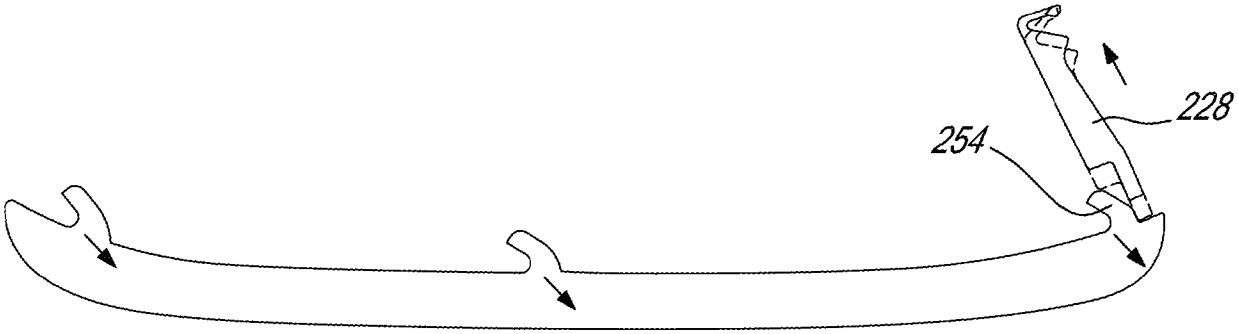
FIG. 14 is a schematic side view of the blade and locking arm of FIG. 11, the locking arm being shown in an unlocked position.

The locking arm 228 is also movable between a locked position (FIG. 11) maintaining the blade in the engagement position, and an unlocked position (FIG. 14) allowing the blade to move to the disengagement position, with a major part of the locking arm 228, including a finger-engaging portion **228*a* configured to be manipulated by the user, remaining outside of the holder, i.e. exposed to the environment. An outer wall of the rear pedestal 232 also has an opening 264 defined therethrough in communication with the recess 244 of the rear pedestal 232 and as shown in FIG. 11, in the locked position, the engagement end 266 of the locking arm 228 engages the rear projection 254 through this opening 264 to retain the rear projection 254 in engagement with the recess 244 and maintain the blade in the engagement position. However, in this embodiment, the opening 264 is defined in an upwardly facing shoulder such that the engagement end 266 enters the recess 244 through the opening 264 through movement along a generally downward direction. As shown in FIG. 14, in the unlocked position, the locking arm 228 is disengaged from the rear projection 254, and the blade is movable to its disengagement position so that both projections 252, 254 are removed from their respective recess 242, 244 to disengage the blade from the holder. A greater portion of the engagement end 266 is thus received in the recess 244 in the locked position than in the unlocked position; for example, the engagement end 266 may be completely outside of the recess 244** in the unlocked position.

Figure 12:
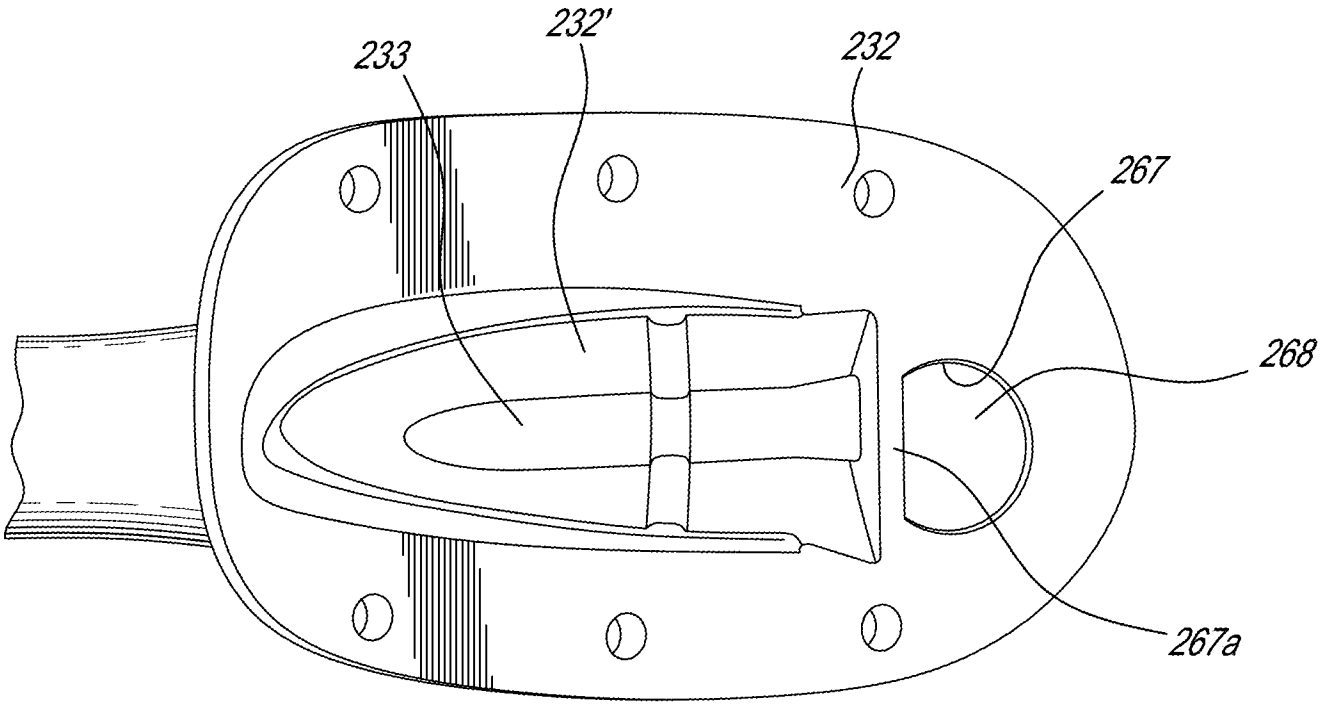
FIG. 12 is a schematic top view of part of the blade holder of FIG. 11.

Referring back to FIG. 11, the engagement end 266 defines a projection sized and configured to be receivable through the opening 264 to abut the convex edge 256 of the rear projection 254 in the locked position. The locking arm 228 rests against an outer surface of the wall of the pedestal 232, and has a deformable end 268 opposed from the engagement end 266, upwardly spaced from the engagement end 266, i.e. located closer to the sole 18 than the engagement end 266. Referring to FIG. 12, the deformable end 268 is connected to the rear pedestal 232 in a fixed location, and in the embodiment shown penetrates in a top recess 267 the rear pedestal 232. The top recess 267 is not in communication with the pedestal's internal cavity 232'; a wall **267*a* extends between the internal cavity 232' and the top recess 267. The whole locking arm 228 thus remains outside of the pedestal's internal cavities 230', 232'** in both the locked and unlocked positions.

The locking arm 228 is movable between the locked and unlocked position by sliding along the outer surface of the rear pedestal 232. The deformable end 268 is deformable and is compressed when the locking arm 228 moves from the locked position to the unlocked position, thus allowing the engagement end 266 to slide away from the rear projection 254. The deformable end 268 is reversibly (e.g. elastically) deformed when in the unlocked position, such as to be in a compressed state biasing the locking arm 228 toward the locked position (shown in dotted lines in FIG. 14). Alternately, the deformable end 268 may be replaced by any other appropriate reversibly deformable element, such as for example any appropriate type of spring.

Figure 13:
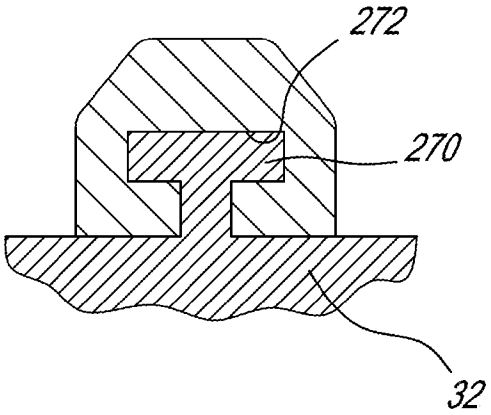
FIG. 13 is a schematic cross-sectional view of the locking arm and part of the blade holder of FIG. 11.

Referring to FIG. 13, in a particular embodiment the outer surface of the pedestal defines a rail 270, for example having a T-shaped cross-section, and the locking arm 228 has a complementary elongated recess 272 defined therein in sliding engagement with the rail 270, such as to guide the sliding motion of the locking arm 228 between the locked and unlocked positions. Alternately, the cross-section of the rail 270 and recess 272 may be different from that shown, and/or the rail 270 may be provided on the locking arm 228 with the complementary recess 272 defined in the pedestal 232. Other configurations of guides may alternately be used.

Figure 15:
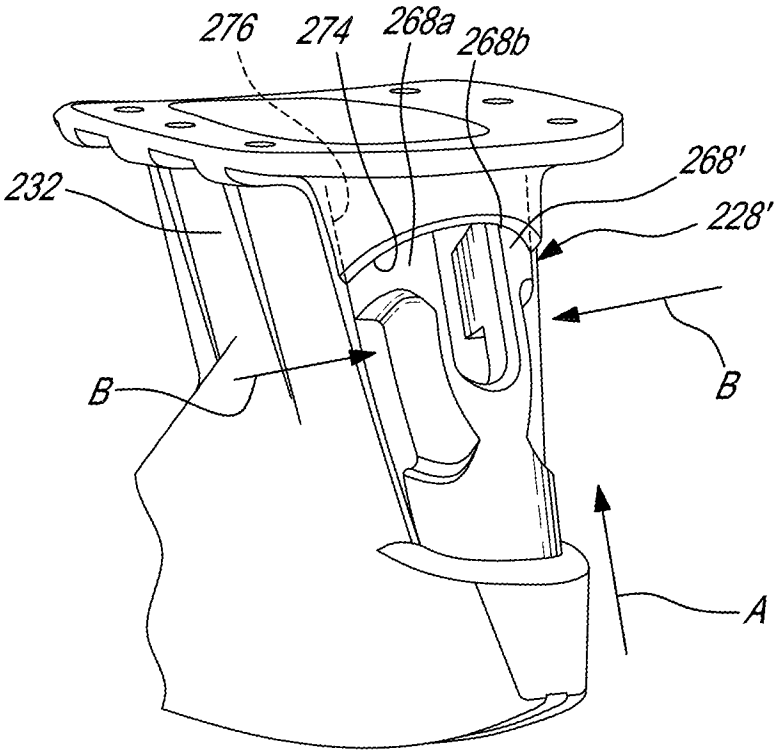
FIG. 15 is a schematic tridimensional view of part of a blade holder and blade, and of a locking arm according to another particular embodiment, the locking arm being shown in a locked position.
Figure 16:
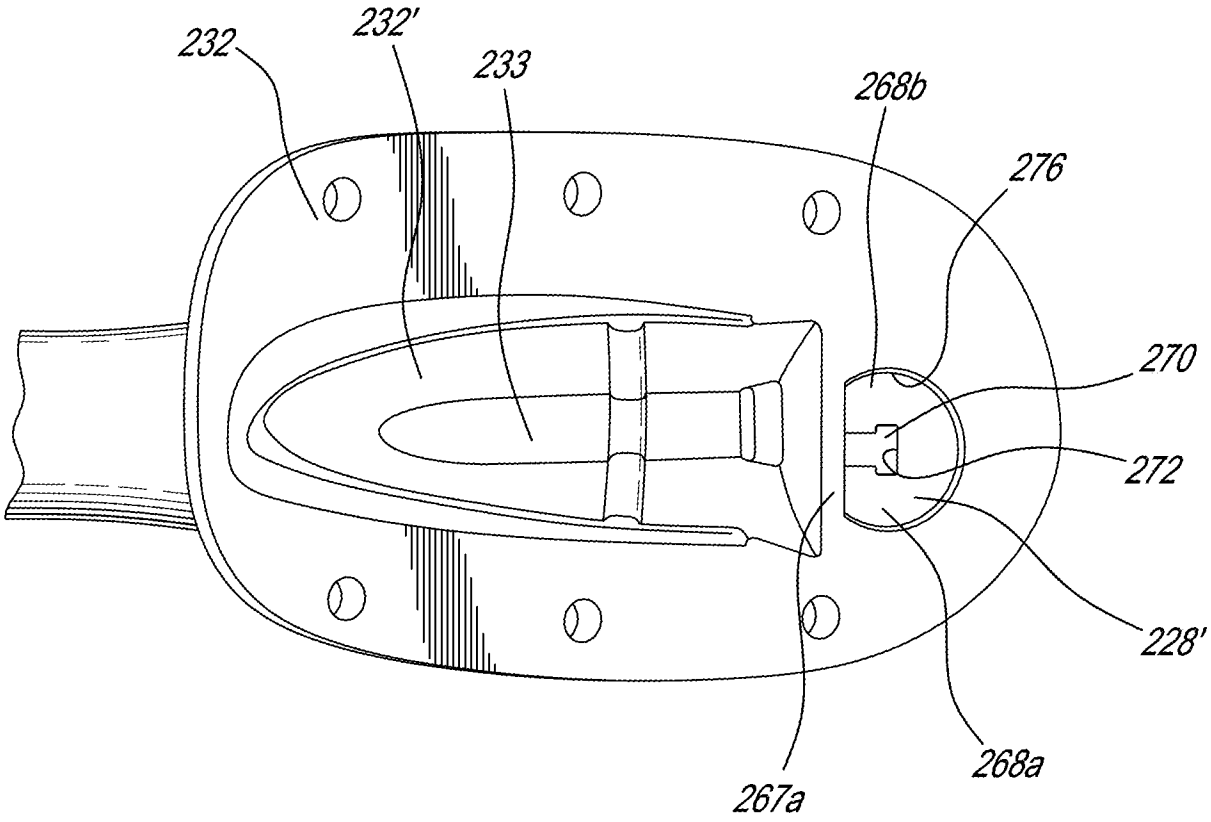
FIG. 16 is a schematic top view of part of the blade holder of FIG. 15.

Referring to FIGS. 15-16, a slidable locking arm 228' according to another embodiment is shown. The locking arm 228' is similar to the locking arm 228 of FIGS. 11-14, slidable between a locked position (as shown) maintaining the blade and holder engagement, and an unlocked position (following arrow A) allowing the blade to be removed; a major part of the locking arm 228', including the finger-engaging portion configured to be manipulated by the user (as shown by arrows B), remains outside of the holder, i.e. exposed to the environment throughout this movement. The locking arm 228' engages the blade similarly to the locking arm 228 of FIGS. 11-14, and is also slidingly engaged to the outer surface of the pedestal, for example through a rail engagement such as shown in FIG. 13 and previously described. Other configurations are also possible.

The rear outer surface of the pedestal 232 has a shoulder 274 with a downward-facing surface defined therein. The downward facing surface of the shoulder 274 has an opening 276 defined therethrough, extending upwardly into the pedestal 232. The locking arm 228' has a deformable end 268' including two spaced apart legs 268*a*, 268*b*. In the locked position, the legs 268*a*, 268*b* define a width of the locking arm 228' which is greater than that of the opening 276; abutment of the legs 268*a*, 268*b* against the downward facing surface of the shoulder 274 prevents the locking arm 228' from being slid away from the locked position.

The legs 268*a*, 268*b* are deformable upon being pressed one toward the other, following arrows B. The opening 276 is sized such that when the legs 268*a*, 268*b* are compressed toward each other, the reduced width of the locking arm 228' is smaller than that of the opening 276 in the shoulder 274, and the top of the locking arm 228' can penetrate the opening 276 as shown in FIG. 16, allowing the locking arm 228' to slide up away from the locked position to the unlocked position, allowing removal of the blade from the holder.

As can be seen from FIG. 16, the opening 276 is not in communication with the pedestal's internal cavity 232'; a wall 267*a* extends between the internal cavity 232' and the opening 276. The whole locking arm 228' thus remains outside of the pedestal's internal cavities 230', 232' in both the locked and unlocked positions.

The deformation of the legs 268*a*, 268*b* biases them away from each other. Accordingly, when the locking arm 228' is slid down back to the locked position, the legs 268*a*, 268*b* spring back to their relaxed position to abut the surface of the shoulder 274 and prevent movement away from the locked position. The legs 268*a*, 268*b* are thus biased against movement toward the unlocked position. It is understood that the movement of the legs 268*a*, 268*b* toward one another with a bias toward the position away from each other could be provided by any other configuration, including, but not limited to, a spring member interconnecting the legs 268*a*, 268*b*.

Referring to FIGS. 17-20, an alternate embodiment of the holder assembly 322 is shown, including a locking arm 328 located completely below the internal cavity of the pedestal. The blade 24 and holder 26 are similar to that of FIG. 1, with similar elements being identified by the same reference numerals.

In the embodiment shown, the front recess 342 extends through the bottom wall 331 of the front pedestal 330 so that the front projection 52 of the blade penetrates into the internal cavity 330' of the front pedestal 30; alternately, the bottom wall 331 of the front pedestal 330 may be continuous so that the front projection 52 remains outside of the internal cavity 330', for example such as shown in FIG. 1.

The front and rear projections 52, 54 as shown have a shape similar to that of the embodiment of FIG. 1 and previously described. However, in this embodiment, the front projection 52 snuggly fits into the front recess 342; disengagement of the rear projection 54 from the rear recess 344 is performed through a pivoting motion about the front projection 52 until the front projection 52 can be slid out of its engagement with the front recess 42 to disengage the blade 24 from the holder 26.

Figure 17:
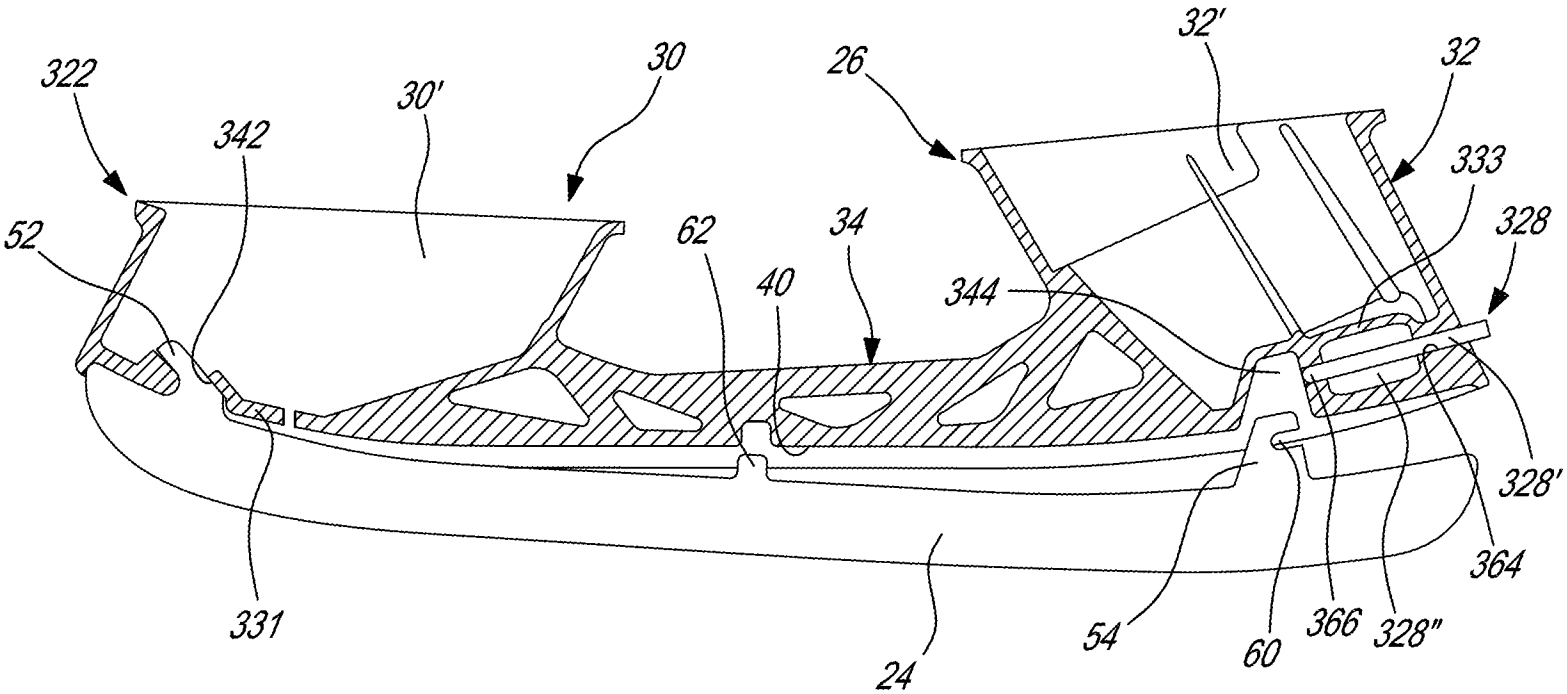
FIG. 17 is a schematic cross-sectional view of a blade holder and blade, and of a locking arm according to another particular embodiment, the locking arm being shown in an unlocked position.
Figure 18:
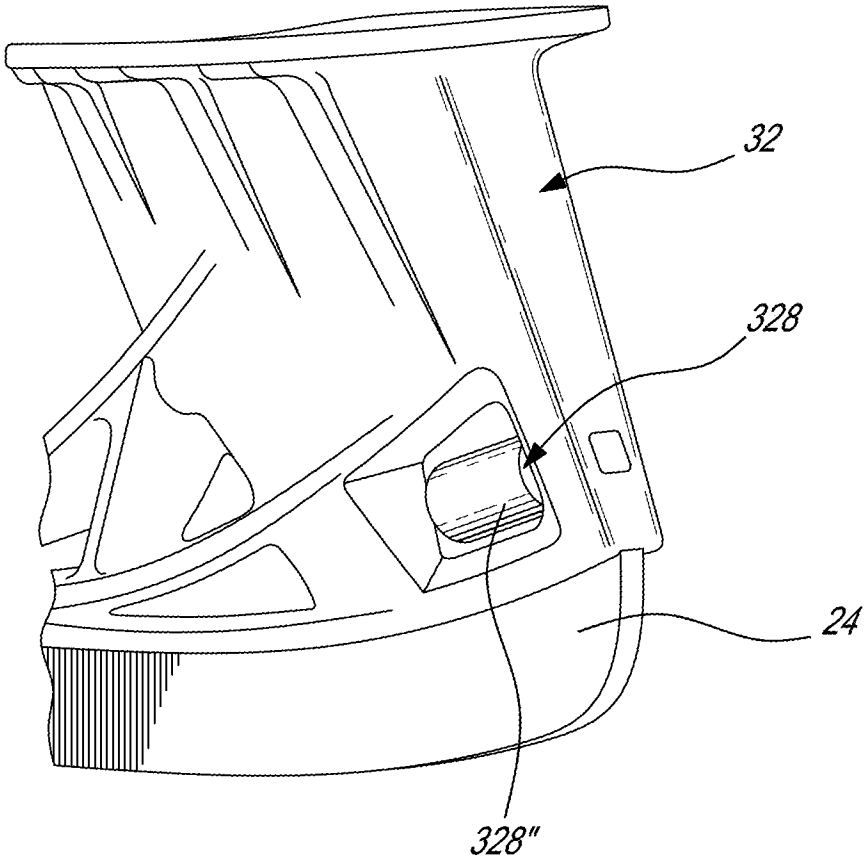
FIG. 18 is a schematic tridimensional view of part of the blade holder and blade of FIG. 17.
Figure 19:
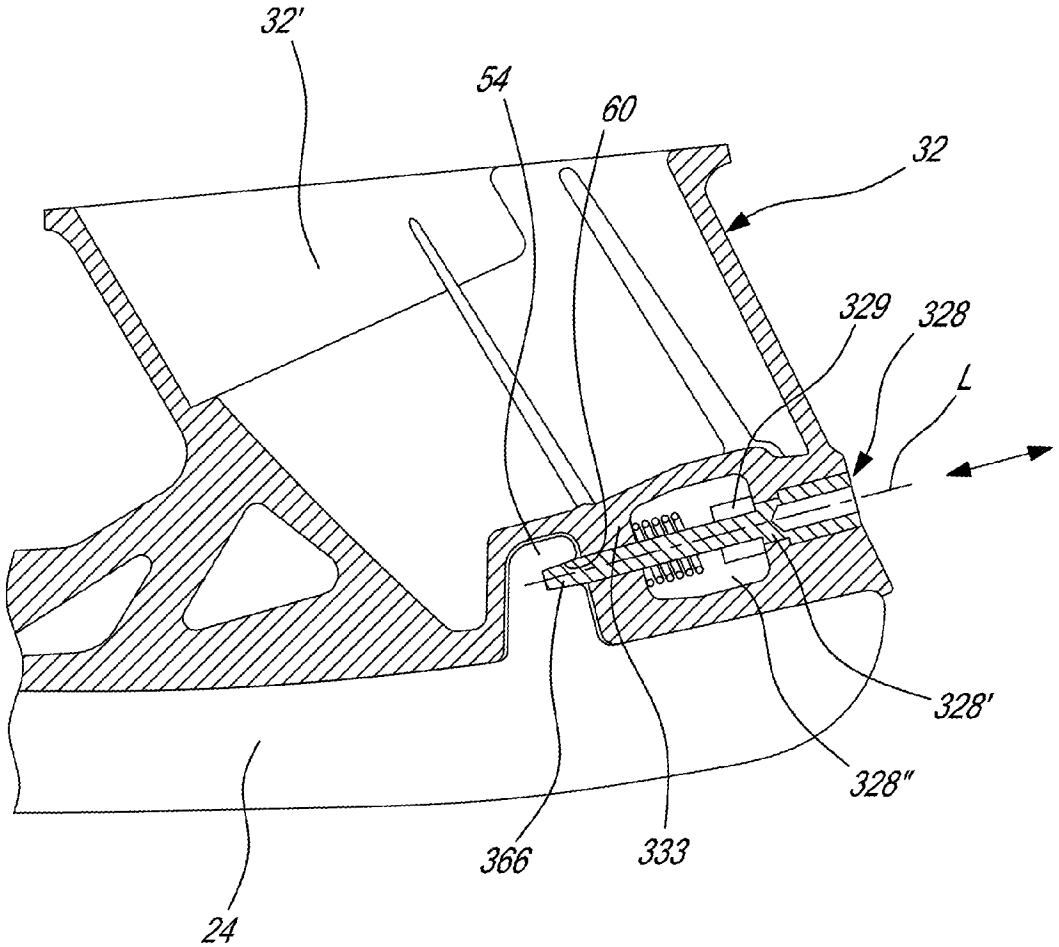
FIG. 19 is a schematic cross-sectional view of part of the blade holder and blade of FIG. 17, with locking arm shown in a locked position.

The locking arm 328 configured for maintaining the blade 24 and holder 26 in their engagement position is connected to the rear pedestal 32, and movable between a locked position (FIG. 19) and an unlocked position (FIG. 17). The bottom wall 333 of the rear pedestal 32 has an enlarged portion including an opening 364 defined therethrough in communication with the recess 344. The opening 364 is horizontal or approximately horizontal, and extends from a rear-facing surface of the rear pedestal 332 to the recess 344. The locking arm 328 includes a pin 328' received in the opening 364. The pin 328' has an engagement end 366 which in the locked position protrudes into the recess 344 and is received in the slot 60 of the rear projection 54 of the blade 24 (see FIG. 19), thus maintaining the rear projection 354 in the recess 344 and maintaining the blade 24 in the engagement position. In the unlocked position, the pin 328' is retracted into the bottom wall 333 and accordingly disengaged from the rear projection 54, so that the blade can be removed.

Figure 20:
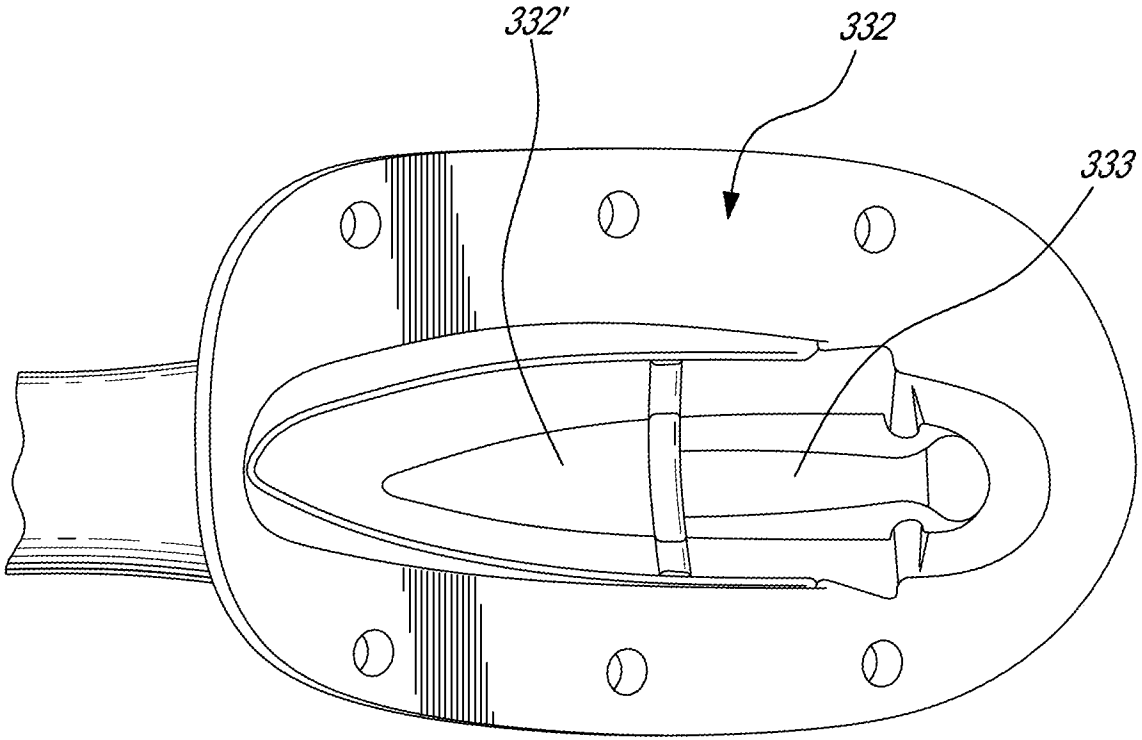
FIG. 20 is a schematic top view of part of the blade holder of FIG. 17.

It can be seen in FIGS. 17 and 20 that the locking arm 328 is completely located below an upper surface of the bottom wall 333, so that the locking arm 328 and blade 24 both remain outside of the internal cavity 32' of the rear pedestal 32 in all positions.

The locking arm 328 further includes a threaded sleeve 328" which is manually rotatable. As can be best seen in FIG. 19, the threaded sleeve 328" surrounds a portion of the pin 328' which is complementarily threaded; rotation of the threaded sleeve 328" results in movement of the pin 328' along its longitudinal axis L (FIG. 19), thus moving the pin 328' between the locked and unlocked positions. As can be best seen in FIG. 18, the threaded sleeve 328" is received in a corresponding opening defined through the bottom wall 333 across its width, so that the threaded sleeve 328" is accessible to the user along the sides of the holder 26. The threaded sleeve 328" defines the finger-engaging portion of the locking arm 328, and accordingly the outer surface of the threaded sleeve 328" may include any appropriate surface texture and/or shape (e.g. bumps) facilitating manipulation by the user. The locking arm 328 is thus directly accessible to the user for actuation without requiring inserting one or more fingers within a cavity of the holder, and is located completely outside of the internal cavities 330', 332' of the pedestals.

A friction device 329 (FIG. 19), such as for example a rubber washer, prevents vibrations caused by normal use of the skate from rotating the threaded sleeve 328".

In a particular embodiment, the locking arm 28, 28', 128, 228, 228', 328 which remains at least in major part, and in some embodiments in entirety, outside of the pedestal's internal cavities 30', 32', 230', 232', 330', 330' is easily accessible and actuable by the user, while still providing for sufficient retention of the blade in the blade holder.

The above description is meant to be exemplary only, and one skilled in the art will recognize that changes may be made to the embodiments described without departing from the scope of the invention disclosed. For example, although in the embodiment shown the locking arm is attached to the rear pedestal and removably engageable with the rear projection, it is understood that alternately the locking arm may be attached to the front pedestal and removably engageable with the front projection, or attached to the bridge portion and removably engaged any appropriate part of the blade. In addition or alternately, the engagement position of the blade may be a rearmost position. The locking arm may also alternately be engaged with any adequate portion of the blade other than the front or rear projection. Other modifications which fall within the scope of the present invention will be apparent to those skilled in the art, in light of a review of this disclosure, and such modifications are intended to fall within the appended claims.

The invention claimed is:

1. A blade assembly for a skate, the assembly comprising:

a blade holder including first and second pedestals configured for attachment to the skate, the blade holder having a bottom surface having an elongated groove defined therein, the blade holder having a plurality of recesses defined therein extending upwardly from the elongated groove, the first and second pedestals each having a bottom wall extending above the elongated groove and an internal cavity defined above the bottom wall;

an elongated blade including a body defining an ice-engaging edge, an elongated top edge opposite the ice-engaging edge, and a plurality of projections extending upwardly from the body, the blade and blade holder relatively moveable between an engagement position where the elongated top edge is engaged in the elongated groove and the plurality of projections are each received in a respective one of the recesses, and a disengagement position where the blade is disengaged from the recesses and the elongated groove; and a locking arm engaged to the holder and movable between a locked position and an unlocked position;

wherein in the locked position, the locking arm has an engagement end engaging the blade through an opening defined in a wall of the holder and maintaining the blade in the engagement position;

wherein in the unlocked position, the locking arm is disengaged from the blade and the blade is movable to the disengagement position; and wherein a major part of the locking arm including the engagement end remains outside of the internal cavities of the first and second pedestals in the locked and unlocked positions.

2. The blade assembly as defined in claim 1, wherein the whole locking arm remains outside of the internal cavities of the first and second pedestals in the locked and unlocked positions.

3. The blade assembly as defined in claim 1, wherein:

the recesses include a first recess defined in the first pedestal and a second recess defined in the second pedestal;

the projections include a first projection received in the first recess and a second projection received in the second recess;

the locking arm is engaged to the first pedestal; and the engagement end of the locking arm in the locked position engages the first projection through the opening defined in the wall of the first pedestal, the opening communicating with the first recess without communicating with the internal cavity of the first pedestal, the locking arm maintaining the first projection in engagement with the first recess.

4. The blade assembly as defined in claim 3, wherein in the locked position, the engagement end of the locking arm interlocks with a concave edge of the first projection.

5. The blade assembly as defined in claim 3, wherein the first pedestal is a rear pedestal.

6. The blade assembly as defined in claim 1, wherein the locking arm is biased toward the locked position or against movement toward the unlocked position.

7. The blade assembly as defined in claim 1, wherein the locking arm is movable between the locked and unlocked position by sliding along an outer surface of the wall of the holder.

8. The blade assembly as defined in claim 7, wherein the locking arm includes two spaced apart legs deformable toward one another, the legs being abutted against a surface of the holder when the locking arm is in the locked position, the legs being receivable through an opening defined in the surface only when deformed toward one another, the locking arm being moveable to the unlocked position through engagement of the deformed legs in the opening, the opening being defined outside of and separate from the internal cavities of the first and second pedestals.

9. The blade assembly as defined in claim 7, wherein the locking arm is connected to the holder through a deformable end of the locking arm opposite from the engagement end and connected to the holder in a fixed location, the deformable end being reversibly deformed and in a compressed state when the locking arm is in the unlocked position, the deformable end biasing the locking arm toward the locked position.

10. The blade assembly as defined in claim 1, wherein the locking arm rests against an outer surface of the wall of the holder in the locked position, the locking arm being movable from the locked position to the unlocked position by pivoting away from the outer surface.

11. The blade assembly as defined in claim 1, wherein the locking arm includes a pin and a threaded sleeve surrounding the pin and threadingly engaged therewith, the threaded sleeve extending outside of the holder such as to be rotatable by a user, the pin of the locking arm including the engagement end, the locking arm being movable between the locked and unlocked positions through rotation of the threaded sleeve causing movement of the pin along a longitudinal axis thereof.

12. A blade holder assembly for a skate, the assembly comprising:

a blade holder having a bottom surface partially defined by a pedestal configured for interconnection with a boot of the skate, the bottom surface of the blade holder having an elongated groove defined therein and a recess extending upwardly from the elongated groove in alignment with the pedestal, the elongated groove configured for removably engaging a top edge of a blade and the recess configured for removably engaging a projection of the blade, the pedestal having an internal cavity defined therein separate and spaced from the elongated groove and the recess; and a locking arm engaged to the holder and movable between a locked position and an unlocked position, the locking arm including a finger-engaging portion for manipulation by a user;

wherein in the locked position, the locking arm has an engagement end protruding into the recess through an opening defined in a wall of the pedestal, a greater portion of the engagement end protruding into the recess in the locked position than in the unlocked position; and wherein a major part of the locking arm including the engagement end and the finger-engaging portion remains outside of the internal cavity of the pedestal in the locked and unlocked positions.

13. The blade holder assembly as defined in claim 12, wherein the whole locking arm remains outside of the internal cavity of the pedestal in the locked and unlocked positions.

14. The blade holder assembly as defined in claim 12, wherein the locking arm is biased toward the locked position or against movement toward the unlocked position.

15. The blade holder assembly as defined in claim 12, wherein the locking arm is movable between the locked and unlocked position by sliding along an outer surface of the wall of the pedestal.

16. The blade holder assembly as defined in claim 15, wherein the locking arm includes two spaced apart legs deformable toward one another, the legs being abutted against a surface of the pedestal when the locking arm is in the locked position, the legs being receivable through an opening defined in the surface only when deformed toward one another, the locking arm being moveable to the unlocked position through engagement of the deformed legs in the opening, the opening being defined outside of and separate from the internal cavity of the pedestal.

17. The blade holder assembly as defined in claim 15, wherein the locking arm is connected to the pedestal through a deformable end of the locking arm opposite from the engagement end and connected to the pedestal in a fixed location, the deformable end being reversibly deformed and in a compressed state when the locking arm is in the unlocked position, the deformable end biasing the locking arm toward the locked position.

18. The blade holder assembly as defined in claim 12, wherein the locking arm rests against an outer surface of the wall of the pedestal in the locked position, the locking arm being movable from the locked position to the unlocked position by pivoting away from the outer surface.

19. The blade holder assembly as defined in claim 18, wherein the locking arm has a connection end opposed from the engagement end, the connection end connected to the pedestal in a fixed location, the locking arm being deformable and bending when moving from the locked position to the unlocked position, the locking arm being biased toward the locked position.

20. The blade holder assembly as defined in claim 12, wherein the pedestal is a rear pedestal.

21. The blade holder assembly as defined in claim 12, wherein the pedestal includes a bottom wall extending between the internal cavity and the recess, and wherein the locking arm includes a pin and a threaded sleeve surrounding the pin and threadingly engaged therewith, the pin of the locking arm including the engagement end and being received in an opening defined in the bottom wall, the threaded sleeve protruding outside of the holder such as to be rotatable by a user, the locking arm being movable between the locked and unlocked positions through rotation of the threaded sleeve causing movement of the pin within the opening along a longitudinal axis of the pin.

22. A skate comprising a skate boot having a sole, and a blade assembly as defined in claim 1 attached to the sole.

* * * * *